US012398630B2

(12) United States Patent
Mitri

(10) Patent No.: US 12,398,630 B2
(45) Date of Patent: Aug. 26, 2025

(54) CRUDE OIL HYDRAULIC LIFT

(71) Applicant: Darrell Schmidt Enterprises, Inc., Brenham, TX (US)

(72) Inventor: George N. Mitri, Brenham, TX (US)

( * ) Notice: Subject to any disclaimer, the term of this patent is extended or adjusted under 35 U.S.C. 154(b) by 0 days.

(21) Appl. No.: 18/538,266

(22) Filed: Dec. 13, 2023

(65) Prior Publication Data

US 2024/0218766 A1 Jul. 4, 2024

Related U.S. Application Data

(60) Provisional application No. 63/477,631, filed on Dec. 29, 2022.

(51) Int. Cl.
*E21B 43/12* (2006.01)
*E21B 41/00* (2006.01)

(52) U.S. Cl.
CPC ..... *E21B 43/126* (2013.01); *E21B 41/00* (2013.01)

(58) Field of Classification Search
CPC ..... E21B 43/126; E21B 41/00
USPC ..... 166/250.01
See application file for complete search history.

(56) References Cited

U.S. PATENT DOCUMENTS 4,548,296 A 10/1985 Hasegawa
7,373,971 B2 5/2008 Montgomery
7,490,674 B2 2/2009 Brecheisen
8,256,504 B2 9/2012 Brown
8,641,390 B2 2/2014 Beck et al.
8,668,475 B2 * 3/2014 Gregory ..... F04B 47/02 417/415
9,567,838 B2 * 2/2017 Marshall ..... E21B 43/126
10,047,739 B2 * 8/2018 Yin ..... E21B 43/126
10,107,295 B1 * 10/2018 Brecheisen ..... G05B 19/042
10,844,852 B2 * 11/2020 Robison ..... F04B 47/14
2013/0306326 A1 11/2013 Doyle
2014/0014318 A1 1/2014 Mail

* cited by examiner

*Primary Examiner* — William D Hutton, Jr.
*Assistant Examiner* — Ashish K Varma
(74) *Attorney, Agent, or Firm* — Park, Vaughan, Fleming & Dowler LLP; Shane Nelson

(57) ABSTRACT

A crude oil lifting system that uses pneumatic and/or hydraulic sources to control vertical operations of a downhole pipe. The lifting system may have a plurality of lifting actuators, a plurality of alignment actuators, and a guiding system. A plurality of hydraulic cylinders may be coupled to an attachment platform that is coupled to a sucker rod. Pressurization and de-pressurization of the hydraulic cylinders causes repeated vertical movement of the sucker rod, thereby retrieving oil or gas from a downhole well. A control system may selectively and individually actuate each hydraulic cylinder and/or pneumatic cylinder based on measurements provided by a plurality of telemetry and/or position sensors. A plurality of permanent or electromagnetic magnets may be utilized to assist in vertical movements of the attachment platform, and a plurality of DC generators may be utilized to generate power from the vertical movement.

10 Claims, 3 Drawing Sheets

CRUDE OIL HYDRAULIC LIFT

This application claims priority to U.S. provisional patent application No. 63/477,631, filed on Dec. 29, 2022, the entire content of which is incorporated herein by reference.

BACKGROUND OF THE INVENTION

Field of the Invention

This invention relates to oil and pump jacks, and more particularly to the use of a hydraulic and/or pneumatic lifting system for lifting oil or gas from a downhole well.

Description of the Related Art

The present disclosure relates generally to the use of a hydraulic and/or pneumatic lifting system for pipes in an oil and gas well. A pumpjack is well known in the art, and is an overground drive that is used to mechanically lift liquid out of the well (from a down-hole pump at the bottom of the tubing) if there is not enough bottom hole pressure for the liquid to flow all the way to the surface. A beam-type pumpjack converts the rotary motion of a motor (prime mover) to a vertical reciprocating motion that is necessary to drive a polished rod and sucker rod to actuate the down-hole pump. With each vertical stroke of the pump jack, a certain amount of liquid is produced from the oil well. Pumpjacks are typically powered by a prime mover, such as an electric motor; however, in some instances an internal combustion engine may also be a prime mover for a conventional pumpjack.

Pumpjacks are simple, but have many problems as is known in the art, including but not limited to the following: large land footprint setups requirement for normal operations; high initial purchase and setup costs; high maintenance cost to maintain normal operations; daily and continuous maintenance requirements; high electrical or fossil fuels operational costs; mechanical and electrical initial setups difficulties; continuous system adjustment requirements based on the levels of oil production; and dangerous and unsafe environment when the system is in operations (safety hazards). The prior art includes various additions and/or alternatives to a typical pumpjack. For example, U.S. Pat. No. 7,490,674 discloses a dual cylinder lift pump to recover fluids from a subsurface location. As another example, U.S. Pat. No. 9,567,838 discloses a long-stroke hydraulic lift system with a linear actuator and a specific combination of a stuffing box and a polished rod. Each of these prior art references is incorporated herein by reference.

A viable oil and gas lifting system is needed that is more efficient and cost-effective than existing systems. A stand-alone lifting station is needed that can better transfer electrical energy into mechanical energy. A stand-alone lifting station is needed that can operate using an on-site, off-grid solar electrical power. A stand-alone lifting station is needed that can provide reduced operation costs and decreased purchase cost of the overall system. A hydraulic lifting station is needed that is environmentally sensitive, durable, cost-effective, quiet, easily transportable, and viable in a wide range of applications and operating conditions. In one embodiment, the disclosed hydraulic lift is intended to replace a conventional pumpjack.

SUMMARY

The system and method of the present disclosure is a crude oil lifting system that uses pneumatic and/or hydraulic sources to control vertical operations of a downhole pipe. The lifting system may have a plurality of lifting actuators, a plurality of alignment actuators, and a guiding system. A plurality of hydraulic cylinders may be coupled to an attachment platform that is coupled to a sucker rod. Pressurization and de-pressurization of the hydraulic cylinders causes repeated vertical movement of the sucker rod, thereby retrieving oil from a downhole well. A control system may selectively and individually actuate each hydraulic cylinder and/or pneumatic cylinder based on measurements provided by a plurality of telemetry and/or position sensors. A plurality of permanent or electromagnetic magnets may be utilized to assist in vertical movements of the attachment platform, and a plurality of DC generators may be utilized to generate power from the vertical movement of the attachment platform to be re-utilized in the operations of the present disclosure.

BRIEF DESCRIPTION OF THE DRAWINGS

The following drawings form part of the present specification and are included to further demonstrate certain aspects of the present invention. The invention may be better understood by reference to one or more of these drawings in combination with the detailed description of specific embodiments presented herein.

DETAILED DESCRIPTION

Figure 1:
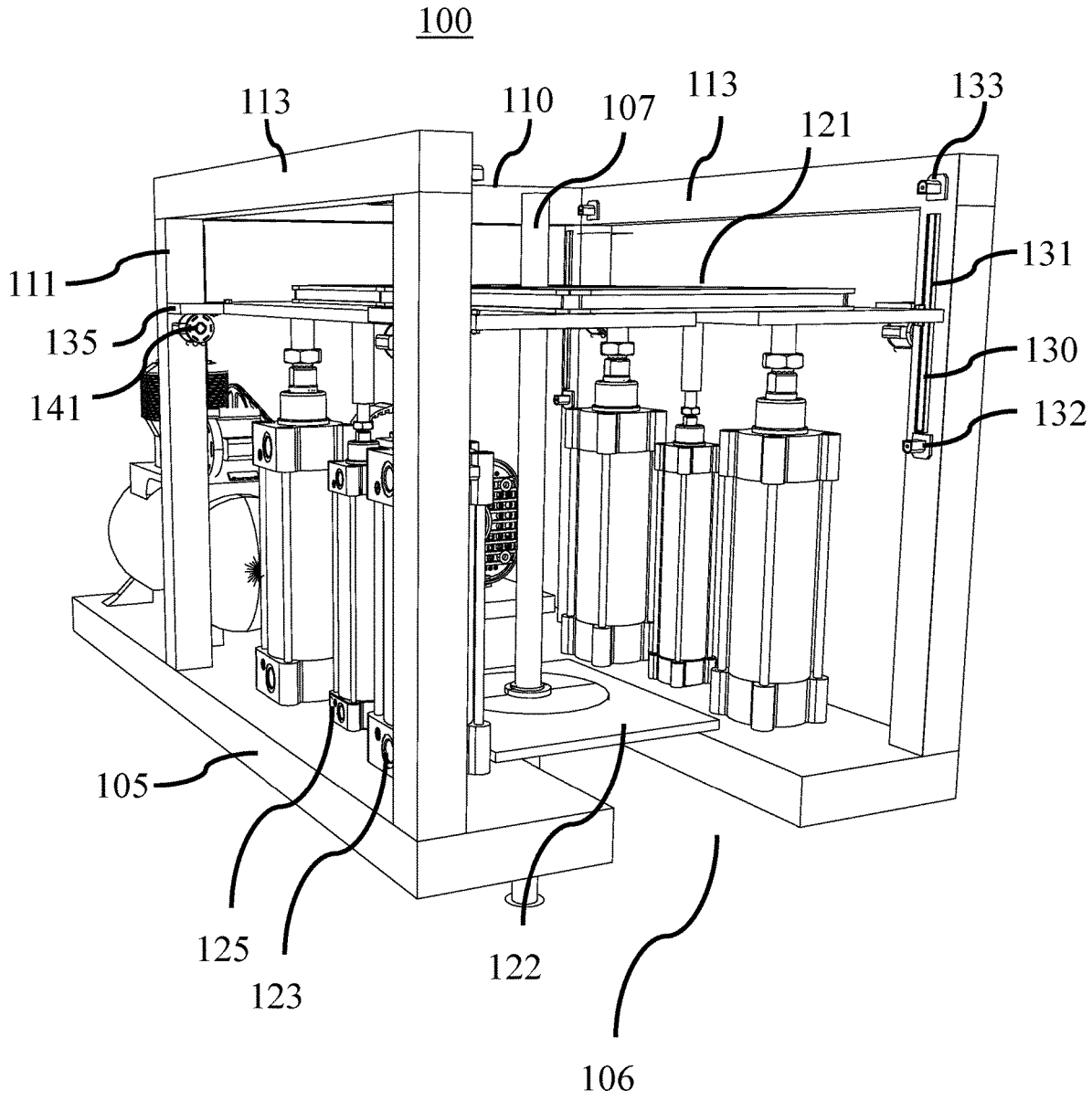
FIG. 1 illustrates a front perspective view of a hydraulic pump jack system according to one embodiment of the present disclosure.

Various features and advantageous details are explained more fully with reference to the nonlimiting embodiments that are illustrated in the accompanying drawings and detailed in the following description. Descriptions of well-known starting materials, processing techniques, components, and equipment are omitted so as not to unnecessarily obscure the invention in detail. It should be understood, however, that the detailed description and the specific examples, while indicating embodiments of the invention, are given by way of illustration only, and not by way of limitation. Various substitutions, modifications, additions, and/or rearrangements within the spirit and/or scope of the underlying inventive concept will become apparent to those skilled in the art from this disclosure. The following detailed description does not limit the invention.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures, or characteristics may be combined in any suitable manner in one or more embodiments.

OVERVIEW

In general, the disclosed oil and gas lifting station uses pneumatic and/or hydraulic sources to control vertical operations of a downhole pipe. The disclosed system is simpler, smaller, and more cost effective to assist in lifting oil and/or gas from a downhole well than conventional techniques. In one embodiment, the disclosed system utilizes pressurized hydraulic fluid to extend a plurality of hydraulic cylinders on an upstroke (thereby raising a sucker rod coupled to a downhole pipe) and recovers that hydraulic fluid pressure on the downstroke. Each hydraulic pump may be selectively and individually controlled and may be coupled to a moveable platform or plate for controlled upstroke and downstroke of the sucker rod. A plurality of pneumatic cylinders may be coupled to the platform to assist in leveling the platform and to be used in conjunction with the required pneumatic pressure to operate the various pneumatic devices used for sampling, chemical additives, and pressure controls of the downhole oil and gas well system. The disclosed system may have a plurality of telemetry measuring and sensing devices and/or position sensors to identify the position of each hydraulic cylinder for controlled vertical movement. The disclosed system is configured to regulate each of the hydraulic cylinders (in response to increasing or decreasing the pressure of the hydraulic fluid delivered to each of the cylinders) based on measurements by the position sensors to maintain a balanced vertical lifting force on the sucker rod and platform. The disclosed system may have a plurality of DC generators coupled to the moveable platform that produces power with movement of the platform (in response to movement of the hydraulic cylinders). The disclosed system may have or be coupled with a hydraulic pump and air compressor. The disclosed system may comprise a plurality of permanent or electromagnetic magnets positioned to control movement of the hydraulic cylinders in the extension and retraction movements.

Figure 2:
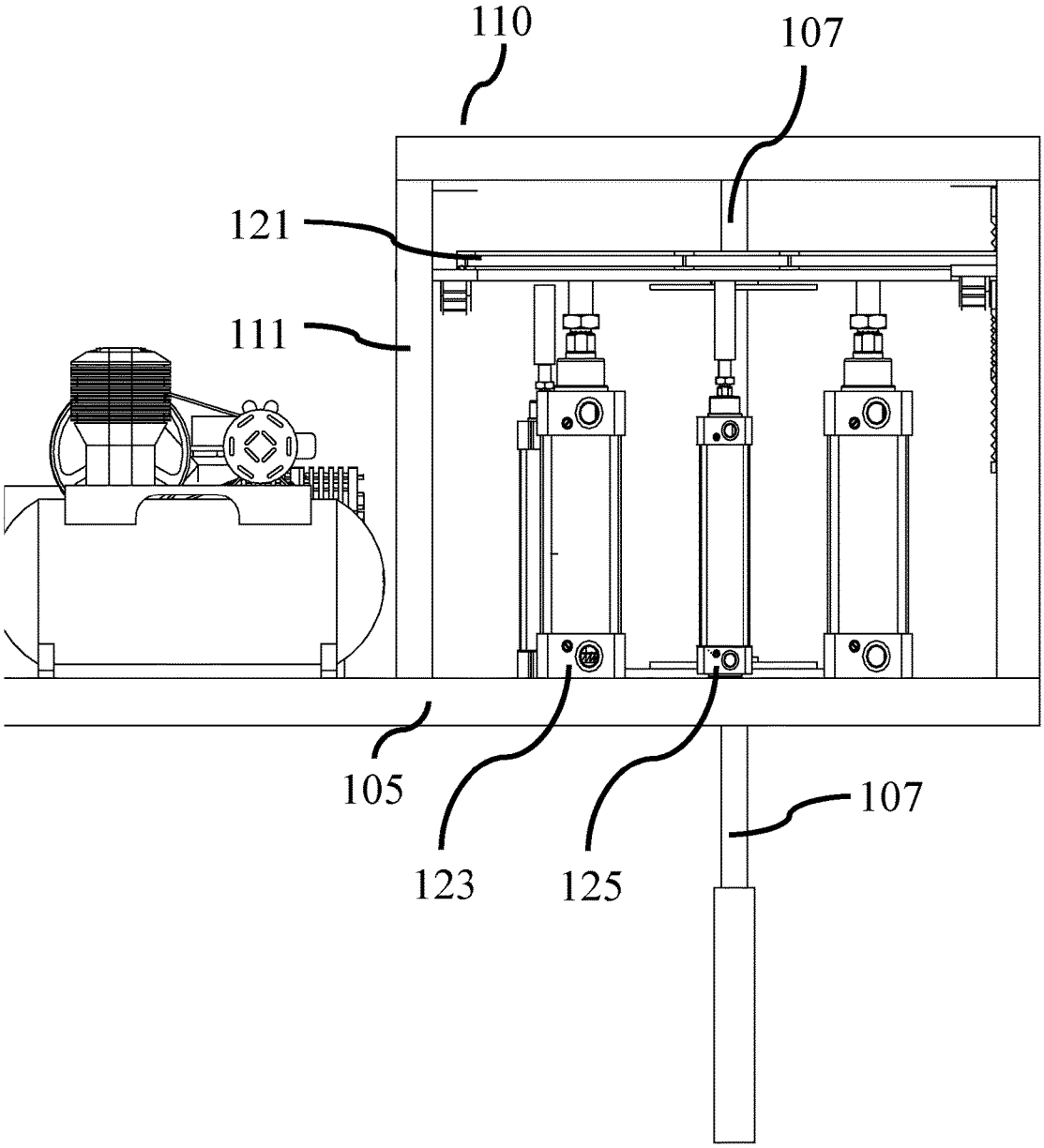
FIG. 2 illustrates a left orthographic view of the pump jack system of FIG. 1.
Figure 3:
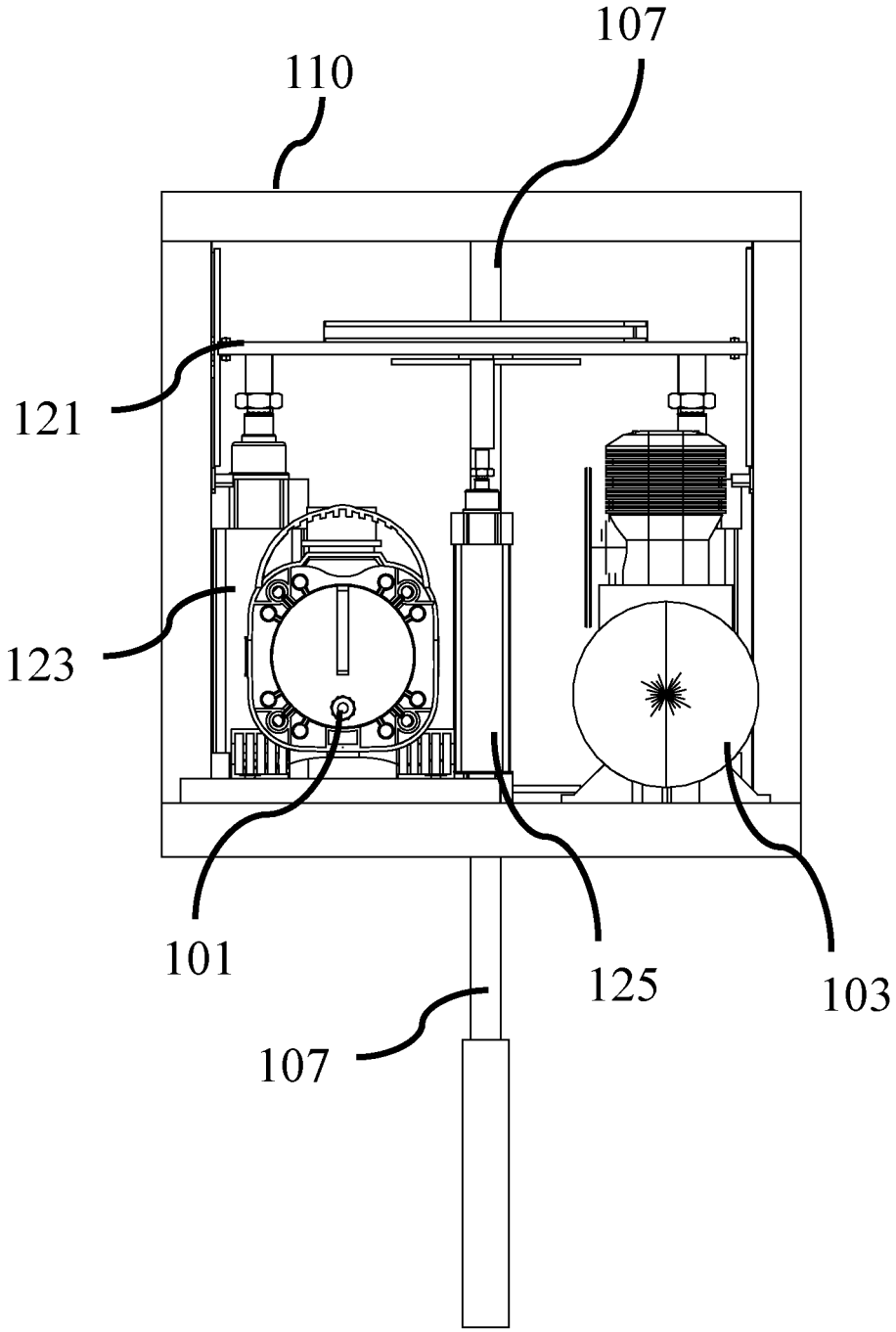
FIG. 3 illustrates a rear orthographic view of the pump jack system of FIG. 1.

FIG. 1 illustrates a front perspective view of a hydraulic pump jack system according to one embodiment of the present disclosure. FIGS. 2 and 3 illustrate a left and rear orthographic view of the hydraulic pump jack system of FIG. 1. For simplicity, not each of the components are illustrated and/or numbered across all of the figures.

FIG. 1 illustrates a lifting system 100 that comprises hydraulic pump 101, air compressor 103, and lift assembly 110, each of which may be positioned on platform base 105. Platform base 105 may be placed on the ground near a downhole well. Lifting system 100 is positioned around and/or coupled to sucker rod 107. Lift assembly 110 is directly coupled to an upper portion of sucker rod 107. As is known in the art, sucker rod 107 is coupled to a downhole pump at the bottom of the well. Hydraulic pump 101 and air compressor 103 can be standard off the shelf components, sized accordingly for lift assembly 110. In some embodiments, the hydraulic pump and air compressor may be coupled to other portions of the oil and gas equipment at the well site for improved and/or integrated system performance. In one embodiment, the electrically operated air compressor is set to operate only when the air pressure within the air compressor tank falls below a certain pressure level, thus reducing the electrical power consumption to a minimum. In one embodiment, portions of lift assembly 110 may be configured for vertical movement and be coupled to the sucker rod, such that the sucker rod 107 is vertically moved as desired by the vertical lift assembly. For the power needed to power the system, the disclosed system may be coupled to the electric grid, a portable or stationary generator, solar panels, a battery supply system, or an electric power station such as that disclosed in U.S. Pat. No. 9,768,632, incorporated herein by reference.

In one embodiment, lift assembly 110 comprises an open frame structural assembly or housing with four vertical members 111 coupled to a plurality of horizontal members 113. Base 105 may have an open section 106 such that lift assembly 110 may be horizontally slid into position at the oil and gas operation site around sucker rod. Lift assembly 110 comprises sucker rod attachment platform 121 that is directly coupled to sucker rod 107. One of ordinary skill in the art will realize that multiple connections between the attachment platform 121 and sucker rod 107 can be made. Vertical movement of attachment platform 121 vertically moves sucker rod 107. Lower plate 122 may be positioned on base 105 and be positioned around a lower portion of sucker rod 107. In one embodiment, lower plate 122 does not move with vertical movement of the sucker rod 107 or attachment plate 121.

In one embodiment, lift assembly 110 comprises lifting actuators 123 and alignment actuators 125 coupled to attachment platform 121 and a guiding system for the attachment platform. In one embodiment, lifting actuators may comprise a plurality of hydraulic cylinders 123, while alignment actuators may comprise a plurality of pneumatic cylinders 125. In some embodiments, only hydraulic cylinders are utilized, while in other embodiments only pneumatic cylinders are utilized. A lower section of the hydraulic and pneumatic cylinders may be coupled to base 105, while an upper section of the hydraulic and pneumatic cylinders may be coupled to a lower section of attachment platform 121. In one embodiment, each of the hydraulic cylinders 123 and/or lifting actuators are attached to the attachment platform near the platform corners, and the pneumatic cylinders 125 and/or alignment actuators are positioned between the hydraulic cylinders and coupled to the attachment platform accordingly. In one embodiment, each hydraulic cylinder and pneumatic cylinders may be individually and selectively activated by a control system. As would be known in the art, fluid connections are needed between the air compressor and the hydraulic pump to each of the cylinders. Such hoses and similar connections are not shown for convenience purposes. In one embodiment, each pneumatic cylinder 125 comprises an air intake and air exhaust, such as an air breather. In one embodiment, pressure from hydraulic pump 101 actuates and/or extends each of the hydraulic cylinders to vertically move attachment platform 121 in an uptake position, while release of that pressure retracts each of the hydraulic cylinders to vertically move attachment platform 121 in a downstroke position. This vertical movement (upstrokes and downstrokes) of the attachment platform and hydraulic cylinders actuates a pump downhole in the well and causes oil and/or gas to be lifted and/or produced from the well, similar to a conventional pumpjack. In one embodiment, the vertical stroke of the hydraulic cylinders is 18". FIG. 1 illustrates the lifting apparatus in a partially extended state (not fully retracted and not fully extended). In one embodiment, the down stroke of the pneumatic cylinders (which are attached to platform 121) will cause air to be pumped and pressurized into a main air tank of the air compressor. In one embodiment, the pneumatic pressure generated by the vertical movement of the pneumatic cylinders may also be used for other pneumatic devices located onsite where the lift assembly device is installed. The pneumatic devices may vary in size and function. In one embodiment, the pressurized air is a positive byproduct of the vertical movement of the cylinders, thus, enhancing the total value of the lift assembly device.

In one embodiment, each vertical member 111 may comprise guiding system 130. Guiding system 130 may comprise a vertical alignment apparatus such as rail or channel 131 inset within the vertical member. In one embodiment, a tab or guide 135 coupled to a corner portion of attachment platform 121 is configured to be received by and/or positioned in channel 131. In one embodiment, as the attachment platform vertically moves within the housing and/or structural assembly of the lifting assembly 110, a corresponding guide 135 moves within the alignment apparatus or channel 131. Such a guiding system keeps the attachment platform relatively aligned and allows for vertical measuring of the attachment platform. In one embodiment, the guiding system shows the vertical position and/or movement of a portion of the sucker rod attachment platform. For example, lower sensor 132 and upper sensor 133 may be positioned at the upper and lower ends of channel 131. In one embodiment, these sensors may be telemetry and/or position sensors (such as mechanical or photoelectronic sensors) as is known in the art. In one embodiment, the sensors may be used to electronically detect and monitor the position of the attachment platform at that corner. In one embodiment, each vertical bar contains an alignment guide and a position indicator, such as a channel and one or more position sensors. In one embodiment, the disclosed lifting assembly may have four guides and eight position sensors, while in other embodiments it may have only two guides and two or four position sensors. The guiding system may comprise upper and lower vertical stops for protection of the lifting system. For example, the attachment platform is vertically restrained at the lower end and upper end when it meets the upper/lower stop. These stops may be variable to change the vertical stroke of the lifting system and to change the upper and lower boundaries of the cylinders for different field applications.

In one embodiment, a plurality of magnets (not shown) are utilized with the lifting system to assist in vertical lift. In one embodiment, magnetic repulsion is utilized to assist in vertical movement. For example, one magnet may be positioned on one portion of the vertical alignment guide (in a fixed position) and another magnet may be positioned on the sucker rod attachment platform in a repulsive arrangement. For example, these magnets may be positioned at upper and lower stops/sensors 132 and 133. The magnetic repulsion slows down the downward descent of the attachment platform and assists in the upward descent of the attachment platform in conjunction with the hydraulic cylinders, thereby providing increased efficiencies and less power requirements for the overall system.

In one embodiment, the lifting system may utilize one or more DC generators. For example, each vertical support 111 may be coupled to DC generator 141, such as with or adjacent to alignment guide 130. In one embodiment, downward vertical movement of the attachment platform actuates DC generator 141 to produce electricity, which can then be transferred to a power supply coupled to the lifting system 100 (such as batteries or an electric power station or another portion of the oil and gas equipment on site).

While not shown in the illustrated figures, one of skill in the art will realize that a control system and/or electronic system is needed to control and regulate the disclosed lifting system. The control system will need to be electronically coupled to each of the lifting actuators (hydraulic cylinders), alignment actuators (pneumatic cylinders), and alignment guides, position sensors, hydraulic pump, air compressor, and power system. The control system will need to be able to selectively and independently actuate each of the hydraulic cylinders and pneumatic cylinders. The control system will need to be able to measure the position of the sucker rod attachment platform and actuate the alignment actuators and lifting actuators accordingly. In one embodiment, the control system comprises a PLC (programmable logic control) that controls the overall operations of the lift station by continuously adjusting the hydraulic pressure. The position sensors continuously send signals indicating the position of the platform and sends measurements to the control system for it to make the appropriate adjustments. The position sensors may be positioned on top and bottom portions of the vertical structural members to properly sense the precise height, inclination, and location of the platform. The PLC is configured to analyze the input data from the position sensors and determines if the system needs any adjustments. In some instances, the control system would command the disclosed lifting system to completely halt operations and shut down the system if the position (angle) of the platform has tilted beyond the set or acceptable levels. In one embodiment, a liquid volume measuring device is installed to sense the production volume to adjust the speed of the lift station. In one embodiment, a weight measuring device is installed to sense the weight of the lift assembly to adjust the speed of the lift station or completely halt the operation of the lift station to conserve electrical power, which will be needed to operate the unit when the volume and weight are again at high levels to resume normal operations. These additional embodiments will increase the system overall efficiency and will decrease the electrical power consumption and decrease the hydraulic and pneumatic pressures required for normal system operations.

In operation, a control system (not shown) actuates the plurality of hydraulic cylinders 123. Pressurization of each cylinder (by the coupled hydraulic pump) extends the cylinders and vertically moves the coupled sucker rod attachment platform 121. At the desired vertical distance (as measured by the guiding system), plurality of hydraulic cylinders 123 are de-pressurized, and sucker rod attachment platform 121 slowly lowers. This position can be determined any number of ways, such as by hitting a stop at the upper stroke and/or a guide system measuring the position of the sucker rod attachment platform. At the desired vertical distance, the control system causes the hydraulic pressure to stop and reverse direction to release the hydraulic liquid and pressure. The directional hydraulic pressure depressurizes the hydraulic cylinders as they slowly lower the sucker rod and attachment platform. The bottom position of the hydraulic cylinder can be determined any number of ways, such as by hitting a stop at the lower stroke and/or a guide system measuring the position of the sucker rod attachment platform. At the bottom of the stroke, the hydraulic cylinders are again pressurized, and the process is repeated continuously. At each stroke, oil (or another fluid, such as water) is produced from the downhole pipe. In some embodiments, the pneumatic cylinders may be used to align the sucker rod attachment platform if the position sensors indicate that one side of the platform is not vertically aligned. In another embodiment, each of the hydraulic cylinders and/or pneumatic cylinders may be selectively and individually actuated to control the relative vertical movement of the attachment platform based on measurements from the guide system (e.g., sensors). In one embodiment, the control system is continuously measuring the vertical position of each corner of the sucker rod attachment platform. If one of the positions is off (based on some predetermined degree of accuracy), one or more of the hydraulic cylinders and/or pneumatic cylinders may be actuated to re-balance and/or realign the attachment platform.

In one embodiment, as the attachment platform moves downward, the pneumatic cylinders pressurize the air from their respective air intake valves. Pressure from the pneumatic cylinders on the downstroke may be used to recharge an accumulator tank for use with the pneumatically operated devices in the field (or on air compressor 103). In another embodiment, the lifting system may comprise a plurality of DC generators (not shown), such that as the attachment platform moves down, the DC generators are actuated to produce power and to slow down the attachment platform (and coupled sucker rod). Further, the downstroke of the hydraulic cylinders may be slowed down by the regenerative breaking action of the coupled DC generators. The generated power of the DC generators may be directed to charge a plurality of battery banks coupled to the lifting system, such as that disclosed in U.S. Pat. No. 9,768,623, incorporated herein by reference.

The disclosed lifting system provides many benefits to a conventional pumpjack. The disclosed lifting system is much cheaper, easier to transport, and install than a conventional pumpjack. Further, the disclosed lifting system requires less power consumption to operate than a conventional pumpjack. For example, a typical pumpjack might require 40-50 hp motor to get 80" of vertical stroke, whereas the disclosed system may require only a 5-7 hp motor to get the needed stroke. By requiring less power, the disclosed system can operate more efficiently and be coupled to (and powered by) renewable energy power sources much easier. Still further, the disclosed lifting system requires much less vertical distance for the stroke; for example, the disclosed system may require only 18-20" of vertical stroke to activate the downhole pump, whereas a corresponding pumpjack might require 120-140" of vertical stroke to operate the same downhole pump. Thus, the overall height (and size) of the disclosed lifting system is much smaller than conventional systems. Additional benefits include at least the following: reduced cost of lift station purchase and setups costs, ease of lift station initial installation and setup, decrease of electrical power consumption, safe on-site operations, low schedule maintenance requirements, ease of system maintenance when required, ease of system transportation "On and Off-Site," and system automation for a more precise and robust operation.

All of the methods disclosed and claimed herein can be made and executed without undue experimentation in light of the present disclosure. While the apparatus and methods of this invention have been described in terms of preferred embodiments, it will be apparent to those of skill in the art that variations may be applied to the methods and in the steps or in the sequence of steps of the method described herein without departing from the concept, spirit and scope of the invention. In addition, modifications may be made to the disclosed apparatus and components may be eliminated or substituted for the components described herein where the same or similar results would be achieved. All such similar substitutes and modifications apparent to those skilled in the art are deemed to be within the spirit, scope, and concept of the invention.

Many other variations in the configurations of the disclosed lifting system are within the scope of the invention. For example, only hydraulic cylinders may be used and not pneumatic cylinders. A wide range of alignment guides and/or position sensors may be utilized. Other attachment devices may be utilized other than the disclosed sucker rod attachment platform. The hydraulic cylinders can be coupled to the sucker rod in any number of configurations. The disclosed lifting system may include a PLC control for overall operations. The system may include magnets, DC generators, liquid volume measuring devices for production sensing, and weight measuring devices to detect weight of the lift station, each of which provides increased efficiency to the overall system. It is emphasized that the foregoing embodiments are only examples of the very many different structural and material configurations that are possible within the scope of the present invention.

Although the invention(s) is/are described herein with reference to specific embodiments, various modifications and changes can be made without departing from the scope of the present invention(s), as presently set forth in the claims below. Accordingly, the specification and figures are to be regarded in an illustrative rather than a restrictive sense, and all such modifications are intended to be included within the scope of the present invention(s). Any benefits, advantages, or solutions to problems that are described herein with regard to specific embodiments are not intended to be construed as a critical, required, or essential feature or element of any or all the claims.

Unless stated otherwise, terms such as "first" and "second" are used to arbitrarily distinguish between the elements such terms describe. Thus, these terms are not necessarily intended to indicate temporal or other prioritization of such elements. The terms "coupled" or "operably coupled" are defined as connected, although not necessarily directly, and not necessarily mechanically. The terms "a" and "an" are defined as one or more unless stated otherwise. The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system, device, or apparatus that "comprises," "has," "includes" or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations.

The invention claimed is:

1. A method for pumping liquid from a well, comprising
- providing a lifting platform proximate to a well head of a downhole well, wherein the lifting platform comprises an attachment platform;
- coupling the attachment platform to a pump rod string of the well head;
- determining a vertical position of the pump rod string;
- actuating a plurality of hydraulic cylinders coupled to the attachment platform to vertically move the pump rod string to an upper position;
- determining that the upper position of the attachment platform has been achieved;
- de-actuating the plurality of hydraulic cylinders to vertically move the pump rod string to a lower position;
- determining that the lower position of the attachment platform has been achieved; and
- repeating the actuating and de-actuating steps to vertically reciprocate the attachment platform and coupled pump rod string to actuate a downhole pump of the well.

2. The method of claim 1, wherein the lifting platform comprises a base platform and a plurality of vertical members substantially enclosing the pump rod string, the attachment platform, and the plurality of hydraulic cylinders.

3. The method of claim 1, wherein the determining steps comprises measuring a vertical position of the attachment platform based on a plurality of telemetry position sensors coupled to the lifting platform.

4. The method of claim 1, further comprising slowing vertical downward movement of the attachment platform by utilizing a plurality of pneumatic cylinders coupled to the platform and the attachment platform.

5. The method of claim 1, further comprising slowing vertical downward movement of the attachment platform by utilizing a plurality of magnets coupled to the lifting platform.

6. The method of claim 1, further comprising slowing vertical downward movement of the attachment platform by utilizing a plurality of DC generators coupled to the lifting platform.

7. The method of claim 1, further comprising generating power based on vertical downward movement of the attachment platform by utilizing a plurality of DC generators coupled to the lifting platform.

8. The method of claim 1, further comprising individually and selectively actuating each of the plurality of hydraulic cylinders based on measurements of the attachment platform from a plurality of telemetry position sensors.

9. A method for pumping liquid from a well, comprising providing a lifting platform proximate to a well head of a downhole well, wherein the lifting platform comprises an attachment platform;

coupling the attachment platform to a pump rod string of the well head;

actuating a plurality of hydraulic cylinders coupled to the attachment platform to vertically move the pump rod string to an upper position;

de-actuating the plurality of hydraulic cylinders to vertically move the pump rod string to a lower position;

repeating the actuating and de-actuating steps to vertically reciprocate the attachment platform and coupled pump rod string to actuate a downhole pump of the well.

10. The method of claim 9, further comprising:

determining that the upper position of the attachment platform has been achieved prior to the de-actuating step; and determining that the lower position of the attachment platform has been achieved prior to repeating the actuating step.

* * * * *